US008672326B2

(12) United States Patent
Maalouf

(10) Patent No.: US 8,672,326 B2
(45) Date of Patent: Mar. 18, 2014

(54) SMARTY SMART STICKS

(76) Inventor: Rosemarie Maalouf, Bayville, NJ (US)

( * ) Notice: Subject to any disclaimer, the term of this patent is extended or adjusted under 35 U.S.C. 154(b) by 90 days.

(21) Appl. No.: 13/273,554

(22) Filed: Oct. 14, 2011

(65) Prior Publication Data

US 2012/0270621 A1 Oct. 25, 2012

Related U.S. Application Data

(63) Continuation-in-part of application No. 12/316,318, filed on Dec. 11, 2008, now abandoned.

(60) Provisional application No. 61/072,152, filed on Mar. 28, 2008, provisional application No. 61/067,603, filed on Mar. 1, 2008.

(51) Int. Cl.
*A63F 3/00* (2006.01)

(52) U.S. Cl.
CPC ..... *A63F 3/00* (2013.01)
USPC ..... 273/139; 273/292; 273/430

(58) Field of Classification Search
USPC ..... 273/138.1, 139, 141 R, 141 A, 138.2, 273/292, 429–432
See application file for complete search history.

(56) References Cited

U.S. PATENT DOCUMENTS

| | | | | |
|---|---|---|---|---|
| 1,408,952 | A | 3/1922 | Koelle, Jr. | |
| 1,787,521 | A | 1/1931 | Harrington, Jr. | |
| 2,565,702 | A | 8/1951 | Stinson | |
| 3,617,057 | A | 11/1971 | Goldfarb | |
| 3,767,197 | A | 10/1973 | Breslow | |
| 3,900,197 | A | 8/1975 | Inose | |
| 4,635,939 | A | 1/1987 | Makow | |
| 5,551,700 | A | 9/1996 | Druce | |
| 5,836,587 | A | 11/1998 | Druce | |
| 5,951,297 | A | 9/1999 | Schwartz | |
| 6,045,131 | A | 4/2000 | Adams | |
| 6,234,481 | B1 * | 5/2001 | Robertson | 273/243 |
| 7,665,734 | B2 * | 2/2010 | Williams | 273/251 |
| 2004/0262841 | A1 | 12/2004 | Janney | |
| 2006/0043680 | A1 | 3/2006 | Gray | |
| 2008/0265507 | A1 * | 10/2008 | Williams | 273/242 |

OTHER PUBLICATIONS

PCT International Search Report and Written Opinion; PCT/US2008/013609; Rosemarie Maalouf; Jul. 29, 2009.

* cited by examiner

*Primary Examiner* — William Pierce
(74) *Attorney, Agent, or Firm* — Gearhart Law LLC

(57) ABSTRACT

A game is described which includes playing media such as sticks or cards. The playing media have a first side with an identifying indicia and a second side with a question and its corresponding answer. The game consists of players collecting sticks for providing correct answers to the questions on the media. The object of the game is to collect the most media in a specified period.

9 Claims, 4 Drawing Sheets

SMARTY SMART STICKS

CLAIM OF PRIORITY

This application claims the priority of U.S. Ser. No. 61/072,152 filed on Mar. 28, 2008, U.S. Ser. No. 61/067,603 filed on Mar. 1, 2008, U.S. patent application Ser. No. 12/316,318, (which published as US2009/0218768 A1), and PCT application No. PCT/US2008/013609, all of which are incorporated herein by reference.

FIELD OF THE INVENTION

The invention relates to the field of games, particularly educational games for school age children.

BACKGROUND OF THE INVENTION

The present invention relates to the field of games, particularly games for children that are educational. While there are many educational games currently on the market, the present invention contains features that the prior art lacks.

U.S. Pat. No. 1,408,952 teaches a card game with two sets of cards; one set of "lesson" cards with one set of "penalty" cards. The game is intended to simulate certain of the work and experiences of the school life of a child passing from the lowest school grade to and through high school.

U.S. Pat. No. 1,787,521 teaches a game in which each player receives a board and markers, the markers bearing indicia indicating where they belong on the board. The object of the game is for a player to remove all of his own markers from his board before his opponents. The removal of the markers is controlled by the rolling of indicator sticks.

U.S. Pat. No. 2,565,702 relates to improvements in playing cards and more particularly to a pack of cards specifically designed for affording amusement in playing interesting games, as well as for educational purposes for giving actual practice in simple fundamentals of mathematics, including addition, subtraction, multiplication, division, and matching of combinations of numerals and colors.

U.S. Pat. No. 3,617,057 teaches a game and method of playing same which comprises a plurality of elongated sticks, preferably in groups of different indicia, and a ring through which the sticks are initially placed such that they can become freestanding in a generally conical configuration. Cards are provided for indicating a stick of a given indicia to be removed from the freestanding sticks by pulling the same through the ring.

U.S. Pat. No. 3,767,197 teaches a question and answer type of game which includes, in combination, a plurality of card-like members each bearing question-type indicia, a plurality of cube-shaped answer designation members each having different answer indicia associated with the question indicia on one or more of the cards, and a chute device for receiving the answer designation cubes and maintaining the cubes in the chronological order of their being deposited in the chute by the players of the game. The chute has a funnel portion for receiving the answer designation cubes and a base portion on which the funnel portion is readily removably mounted. The funnel portion has a window on one side thereof to permit visual observation of the answer designation cubes therein. The base portion has means to block the window when the funnel portion is mounted thereon to thereby selectively prevent visual observation of the answer cubes. The funnel portion thus must be removed from the base portion in order to see the answer designation cubes contained therein as well as the chronological order of their having been deposited therein. In the preferred embodiment of the invention, a plurality or set of answer designation cubes are provided for each player of the game so that the players must select the particular cube which will answer questions or solve the problem presented by one or more of the question cards.

U.S. Pat. No. 3,900,197 teaches a game which educates and entertains a child that employs a plurality of elongated sticks, each of which has indicia imprinted on the cross-sectional area of one end and a plurality of cups which may be mounted on a base; for example, an ash tray. The sticks are selectively distributed to the cups in a desired manner.

U.S. Pat. No. 5,951,297 teaches a game for teaching reading skills through phonics and decoding skills. The game provides for increasing student (player) interest by incorporating a wagering system similar to that of casino Blackjack. The wagering aspect makes the game attractive to mature students (players) who are learning to read or are improving their reading skills. The game uses word cards and sentence cards. The word cards have specially-selected words to emphasize important vowel sounds, common two letter combinations (consonant-consonant and consonant-vowel) and are selected to use words falling into categories selected for their universal association. The sentence cards are a logical progression from the philosophy of Universal Associative Learning, and pose questions or assign tasks to emphasize reading comprehension and critical thinking skills. The game also uses timing means which sets a period of time in which the card must be correctly responded to, and also uses chips for the placing of wagers. When there is more than one student reader playing against the banker, the student readers may compete to be the first to correctly respond to a single common card, or may independently attempt o respond to their individual cards.

US Patent Application 20040262841 teaches a color card game comprising a plurality of color cards (10), a plurality of wild cards (12) that may be aggregated in place of the color cards (10), and a chromatic wheel (14) that shows in which order the color cards (10) are to be aggregated. Each card (10,12) displays a unique color comprising a unique mixture of a hue and an intensity. Each of the color cards (10) also includes hue indicia (16) and intensity indicia (18). The wild cards (12) include five grey wild cards of varied intensities to match the intensities of the color cards (10) and may be used in place of any color card (10) having matching intensity. The wild cards (12) also include a white wild card, a black wild card, and a gold wild card, each of which may be used in place of any of the color cards (10).

The present invention teaches an educational game which children play with sticks or cards. One unique aspect of the present invention is that the sticks or cards have a question and answer on the same side, and the players ask each other the question and wait for the correct answer. Having both question and answer on the same side of the stick or card is beneficial to both players, but particularly to the player holding the stick or card. Seeing the question and answer together cements the correct answer in the player's mind through visual learning, and seeing the information during a pleasant activity associates the learning with positive feelings. Another positive learning aspect is that the answer may be announced numerous times during one embodiment of the game, which reinforces learning.

Another advantage of the current invention is ease of set-up and transportation. The entire game consists of a set of sticks or cards and possibly a rounds marker, so there is no bulky board or other pieces to set up, and the game can be set-up in a matter of minutes, simply by passing out the appropriate number of sticks or cards to the players. The rules for the game are elegantly simple as well, allowing play without elaborate instruction time. The educational level of the game is easily altered by choosing sticks or cards with higher level questions for older players, and sticks or cards with lower level questions for younger players. The game also has the advantage that it can still be played if parts become lost, and can be inexpensively expanded by adding new sticks or cards from expansion packs.

Another advantage of the present invention is that the media can be used to play many different embodiments of the basic game so that the entertainment value is increased. Additionally, any number of users can play games with the media, from a one player solitaire game to games of 100 players if teams and expansion packs are used.

The media can also be used in classrooms by teachers, who can act as a 'leader' and ask all of the questions, then award the sticks or cards to the students who get the right answers. A prize may be given to the child who collects the most sticks or cards, or for each correct answer. The students may pick the color category for the day, using a different color group for each day of the week, etc. The permutations on the game are many and can be modified to fit the group at hand.

SUMMARY OF THE INVENTION

The invention is an article of manufacture comprising a playing media having first and second sides wherein the first side has an identifying indicia and the second side has a question thereon and the answer to said question is also affixed to the second side.

The invention is an educational game played with media such as, but not limited to, sticks or cards; the term 'stick' will be used here to indicate all such media. The object of the game is for a player to collect the most sticks. Each stick has a question and its corresponding answer printed on one side, and a design or color printed on the other side. The design or color may be used to separate the sticks into groups. The sticks are held such that the question and answer sides are visible only to the players holding them; the other players see the design sides of the sticks.

To begin the game, the sticks are dealt to each player, and a first player is chosen. For 2-5 players, each player preferably gets 10 sticks. For 5-10 players, each player preferably gets 5 sticks. In a first preferred embodiment, the first player chooses a stick that is held by a second player. The second player retains the stick and asks the first player the question that is printed on the stick. The first player has a set time limit in which to answer. If the first player can't answer in the time limit or answers incorrectly, the second player preferably says the answer and retains the stick. If the first player answers correctly, the second player gives the stick to the first player. In either case, play then moves to the next player, preferably to the player in the clockwise position relative to the first player. Other means for selecting the next player may be employed. The game is played for a pre-determined number of rounds or a set time period.

It is an object of the invention to educate children in an entertaining manner.

It is an object of the invention to provide children with a fun and interactive educational game.

It is an object of the invention to provide educational tools for children.

It is an object of the invention to provide educational tools for teachers.

It is an object of the invention to provide a game that can be played anywhere.

It is an object of the invention to provide a game that can be played with minimum set-up time.

It is an object of the invention to teach children a variety of subjects.

It is an object of the invention to be easily transported and stored.

It is an object of the invention to have an attractive appearance to engage children and adults.

It is an object of the invention to provide a game that can be played in a short amount of time if necessary.

It is an object of the invention to provide a game that can be played by 1 to 10 players or more.

It is an object of the invention to provide a game that can be played by children of differing ages and knowledge levels.

It is an object of the invention to provide a game that is durable.

DESCRIPTION OF THE PREFERRED EMBODIMENTS

The preferred embodiments of the present invention will now be described with reference to FIGS. 1-4.

Figure 1:
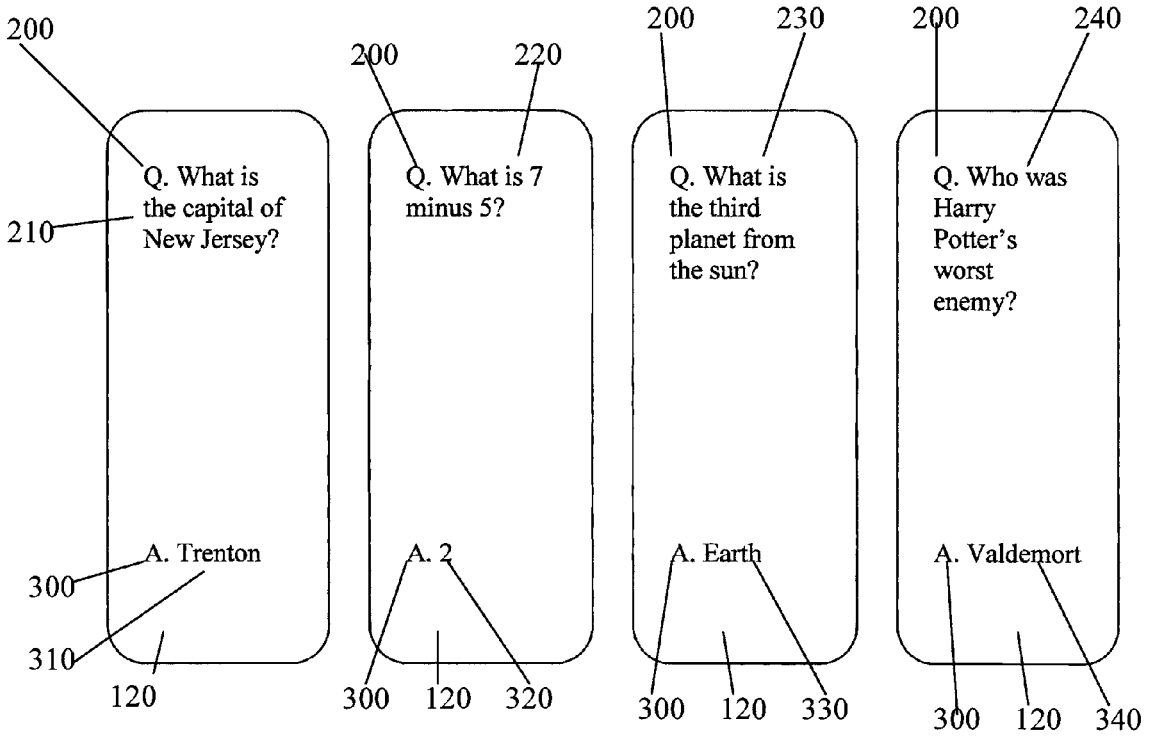
FIG. 1 is a back view of a preferred embodiment of the invention, showing media in the form of sticks with questions and answers on the second side.

FIG. 1 shows the second side 120 of a set of playing media 100 disposed as sticks, each with a question 200 and an answer 300. FIG. 1 shows medium with a social studies question 210 with its corresponding correct answer 310, a medium with a math question 220 and its corresponding correct answer 320, a medium with a science question 230 and its corresponding correct answer 330, and a medium with a language arts question 240 and its corresponding correct answer 340.

Figure 2:
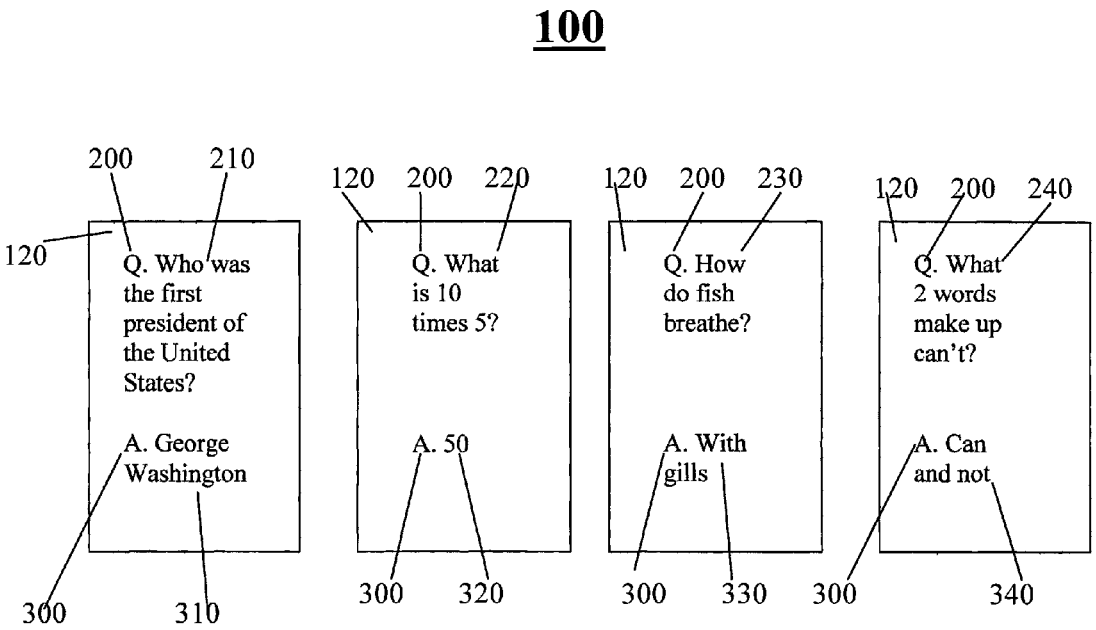
FIG. 2 is a back view showing cards with questions and answers on the second side.

FIG. 2 shows the second side 120 of a set of playing media 100 disposed as cards, each with a question 200 and an answer 300. FIG. 2 shows medium with a social studies question 210 with its corresponding correct answer 310, a medium with a math question 220 and its corresponding correct answer 320, a medium with a science question 230 and its corresponding correct answer 330, and a medium with a language arts question 240 and its corresponding correct answer 340.

The questions and answers shown on the media in FIGS. 1 and 2 could be from any subject, including but not limited to, entertainment, travel, animal facts, TV trivia, foreign language, other trivia, sports, food and drink, modern living, popular music band or musician names, weather facts, with the preferred subjects those that children learn in school, such as math, science, language arts, social studies, music, health, etc. Moreover, the questions can be in any language.

The questions and answers shown in the figures may be placed on the media using any method, including but not limited to, printing, including but not limited to, laser printing, ink jet printing, digitally transferring the data; engraving, typing, and Braille.

The playing media may have one question or two or more questions and answers on the second side. Additionally, the first side of the playing media may contain any indicia or design. Preferred embodiments would have the words 'Smarty Smart Sticks', with or without the category of the question, with or without the age group that the questions are geared toward, with or without the website information, and with or without a possible code on playing media which may be collector playing media.

The game and questions can be geared to age appropriate categories, such as for children ages 4 to 7, 7 to 12, 12 to 18, or adult.

The media may be manufactured from any material or combination of materials, including but not limited to, wood, plastics, rubbers, paper, cardstock, cardboard, glass, fiberglass, elastomers, metals, plant materials, foods, animal parts, cloth, leather, composites, minerals, or any combination thereof. The media can be any size or shape suitable for the particular application. In the case of the sticks, the sizes may, but will not necessarily, have dimensions of 2 to 8" in height and ¼" and 1' in width. If the media is a card, then likely dimensions are between 2" and 6" in height and 1" and 5" in width. The game may have any number of media, but will preferably have at least 50, but could have 100 media or more.

Figure 3:
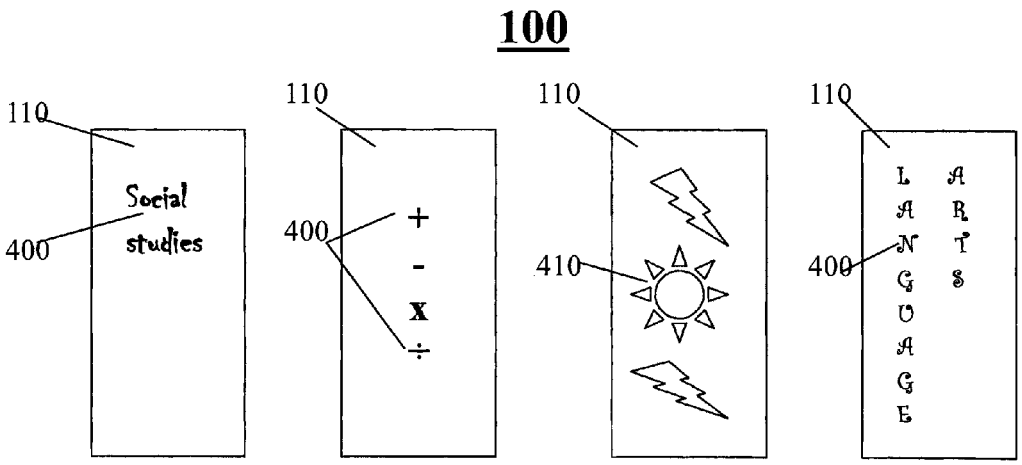
FIG. 3 is a front view, showing designs and words on the first side of the media.

FIG. 3 shows the first side 110 of a set of playing media 100 disposed as cards. FIG. 3 shows 3 different media with indicia 400, and one medium with a design 410.

FIG. 3 shows the media with wording or design as differentiating indicia, but the media could be differentiated from each other by any means, including but not limited to, color, media thickness, the material from which the media are manufactured, shape, size, or feel, feel including but not limited to whether the surface is rough or smooth. Also, the indicia could be anything, including but not limited to, words, patterns, digital images, personalized designs such as but not limited to pictures that are colored by the user, or the media could be differentiated from each other by any combination of any the means described above.

The identifying means could be placed on the media by any method, including but not limited to, printing, engraving, carving, Braille, cutting, die-cutting, digitally transferring images, coloring using any writing or drawing tool, scraping, rubbing, gluing, heat fusing, taping, or other suitable methods.

Although the figures show the media in the preferred embodiment as oblong sticks and rectangular cards, the media could be any shape, including but not limited to, square, rectangle, oblong, polygon, star, triangle, vehicle shape, flower or other nature shape, animal shape, with all or some of the cards being a certain shape or shapes.

Figure 4:
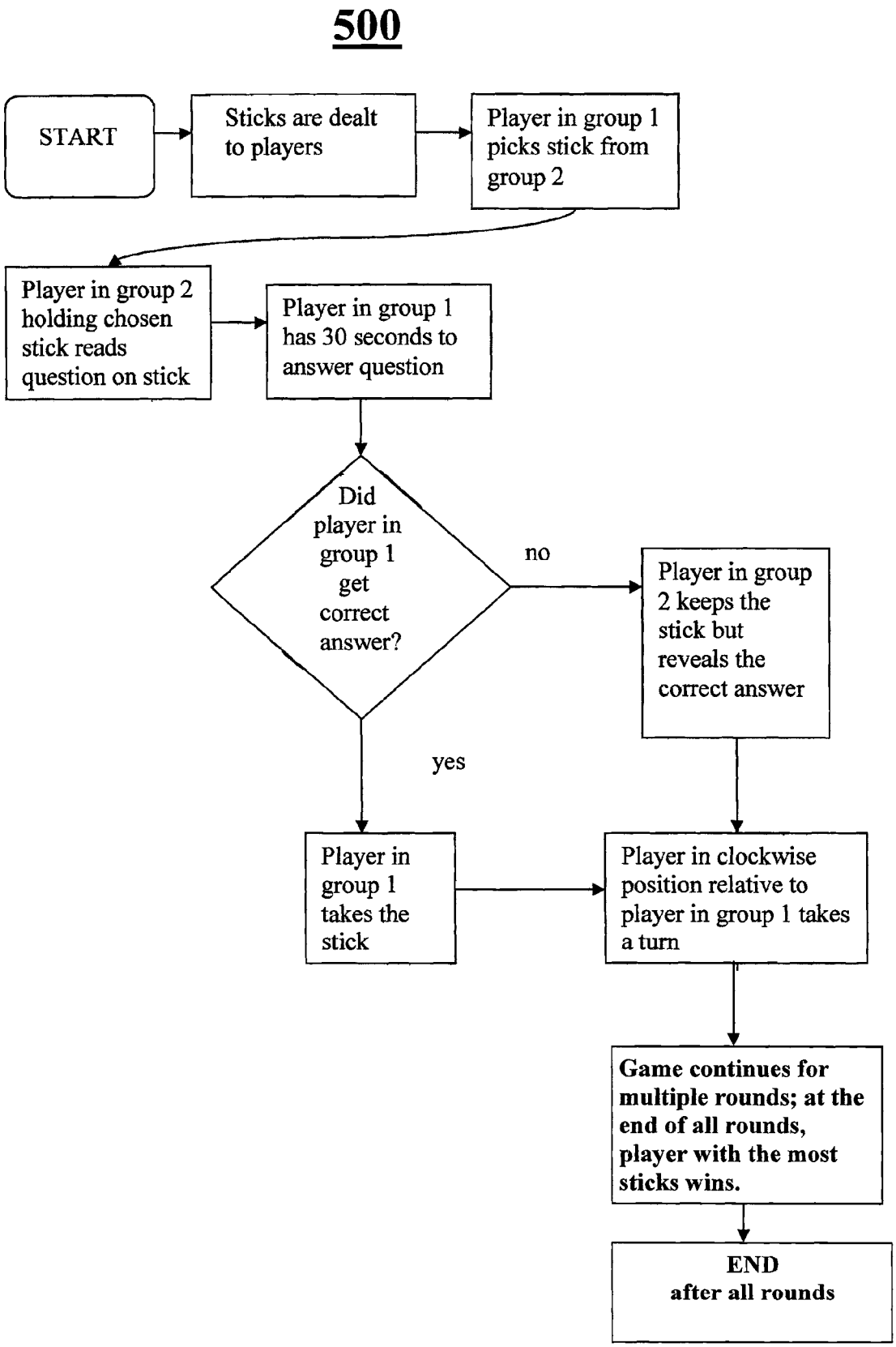
FIG. 4 is a flowchart, showing how the media are used to play a game.

FIG. 4 shows a flowchart of one embodiment of a game played using the playing media.

In this embodiment, there are groups of sticks differentiated by color. The sticks may be grouped such that the sticks with identical designs or colors belong to the same class of question, ie: red sticks are for geography, blue sticks are for science, etc., or so that a group contains one or more questions from each category, i.e., the red and the blue group each contain one geography, one math, one science, and one language arts question. Other colors or indicia, or identifying means and subject categories may be used as well.

If 2-5 users are playing, each player gets 10 sticks. If 5-10 users are playing, each player gets 5 sticks. In this embodiment, each player has sticks only from one color group, such that the first player has all blue sticks. If 1-5 users are playing, then each player has 10 sticks of a unique color. If 5-10 users are playing, then player one and player six may each have 5 blue sticks. If the game is played in an education setting then one or more of the players may not be a teacher.

To start the game, player 1 is chosen through any method amenable to the group or group leader. Player 1 then picks a stick from another player, for instance player 2, and player 2 asks player 1 the question on the stick. If player 1 gets the incorrect answer, then player 2 announces the correct answer to the group and keeps the stick. If player 1 gets the correct answer, then player 2 hands the stick to player one. In either case, the game may proceed to the player who is in the clockwise position relative to player 1. The game is played for any number of rounds, preferably 10, but up to 20 rounds or more. The player with the most sticks at the end of 20 rounds wins.

A system for marking rounds may be employed, such as but not limited to, using a numbered book, using a scratch pad to record rounds played, using a mechanical counter, or using a chip, stone, candy, or other physical item to keep track of rounds.

Many other embodiments exist for playing the game. They include, but are not limited to, using identifying means other than color to identify groups, having 'groups' consist of one category of question or of mixed categories of questions, retaining and keeping cards in play after their answers have been revealed, discarding cards whose answers have been revealed, piling cards in front of the player who won them after their answer is revealed, playing the game as a game of solitaire, playing the game in teams, playing with any number of users and forming teams as necessary, including teams comprised of differing age groups to answer a wide range of questions, adding expansion packs that contain more sticks or cards, and possibly new categories or levels of difficulty, playing until one player or team accumulates all or a vast majority of the cards, giving the answer on the card and having the player guess the question, choosing order of play by any number of means, such as but not limited to, age, height, hair length, number of pets at home, etc. or going counter-clockwise around the group, having a leader ask the questions on the cards and individuals or groups try to answer and be awarded the stick or card for a correct answer, have each player media with either identical or varying indicia, or any combination of these alternate embodiments or other embodiment which can be created to be used with the media of the present invention. For instance, one alternative embodiment of the game may include a player losing a stick or card if he or she gets an answer incorrect. As an additional alternative, the game would end as soon as all sticks or cards are lost by any one player or team.

One group for which the game could have particular use is special needs children and adults. For instance, autistic children may be enticed to learn using the game. Deaf children could either sign their answers or write them on a piece of paper. The sticks or cards could be made with Braille indicia for blind people, with the categories being different shapes or differentiated other ways, such as by sound, which could be accomplished by embedding sound chips in the playing media. Mentally handicapped children and adults could also be taught using the game, and may enjoy the plurality of colors associated with the playing media. In their case, or the case for very young players, pictures may take the place of words in the questions and/or answers.

Figure 5:
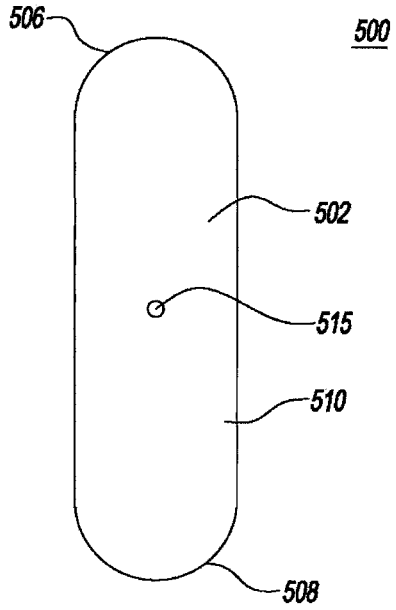
FIG. 5 is a front view of an alternate embodiment of the invention.
Figure 6:
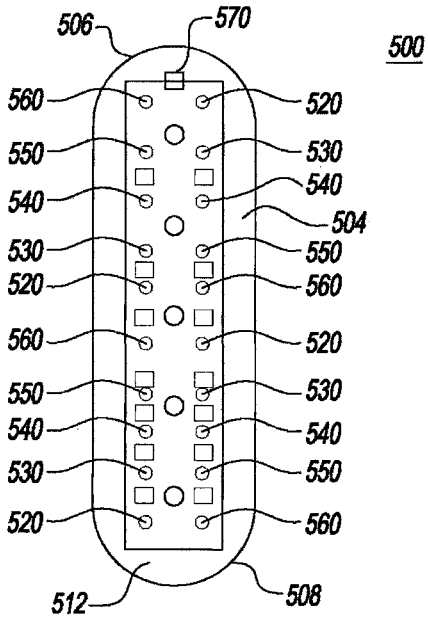
FIG. 6 is a cut-away view of an alternate embodiment of the invention.

FIGS. 5 and 6 show an alternate embodiment of the invention. In this embodiment, a medium that has a transparent case and internal light emitting diodes is used in conjunction with the other media described above, resulting in a different game.

FIG. 5 is a front view of an alternate embodiment of the invention. FIG. 5 shows transparent playing medium 500, transparent playing medium first side 502, transparent playing medium top side 506, transparent playing medium bottom side 508, transparent playing medium top cover 510, and button 515.

FIG. 6 is a cut-away view of an alternate embodiment of the invention. FIG. 6 shows transparent playing medium 500, transparent playing medium second side 504, transparent playing medium top side 506, transparent playing medium bottom side 508, transparent playing medium bottom cover 512, red light emitting diode 520, blue light emitting diode 530, orange light emitting diode 540, yellow light emitting diode 550, green light emitting diode 560, and random sequence generator 570.

FIGS. 5 and 6 show a playing medium that has two sides with light emitting diodes of differing colors disposed between the two sides, a button on the first side that activates the light emitting diodes, and a random sequence generator that determines the order of the different colored light emitting diodes that are activated. The two sides are transparent so that the light emitting diodes that flash inside the medium can be seen from the outside.

When the button 515 is pushed, the random sequence generator 570 is activated for a pre-determined period, from 0.5-50 seconds, preferably approximately 10 seconds. The random sequence generator 570 randomly selects a light emitting diode color group to activate, changing color groups approximately every second in random order. The medium therefore flashes a variety of colors in the 10 seconds, in a different sequence every time the button is pushed, and at the end of 10 seconds stops on a final color. The light emitting diodes for the final color stay activated for a period of approximately 1 to 30 seconds, after which all light emitting diodes are de-activated until the button is pushed again.

The light emitting diodes are arranged inside the medium such that the medium is flashing along its length, as shown in FIG. 6. For example, in the figure there are four red light emitting diodes. They are at the top of the medium, at the bottom, and about halfway between top and bottom. When the random sequencer activates the red light emitting diodes, all four light up simultaneously so that the medium looks red along its length.

Although the colors described in FIG. 6 are red, blue, orange, yellow and green, any colors or combination of colors may be used. Any number of colors may be used, from one color to 50 colors, with five to ten colors the preferred number. Although four light emitting diodes are shown for each color, any number of light emitting diodes may be used, and they may be any shape or size. They may also be disposed anywhere in the transparent playing medium. Alternately, any other form of light emitting device or method may be used, and any other type of activating device may be used in place of the button.

The shape of the medium is preferably as shown, a rectangle with rounded ends, but it may be any shape, including but not limited to, a square, a circle, a star, or a character shape. The material of construction for the transparent sides of the medium is preferably a transparent plastic, but it may be any material that is transparent or semi-transparent.

The button 515 is shown disposed in the center of the transparent playing medium first side 502, but it may be disposed anywhere on the transparent playing medium 500.

This embodiment allows a different game to be played than that described with the other figures. The new game follows the same rules and format as the game previously described, except that it continues past the point when one player loses all of their media. At that point, the player with no remaining media is out of the game, but the other players continue by introducing the transparent playing medium into the game. The player with the most media activates the transparent playing medium, and it flashes through a variety of colors for approximately 10 seconds. The last color displayed may or may not match the color of the playing media of the player who activated the transparent playing medium; if it does match, that player gets to choose a player to eliminate from the game. The player holding the transparent playing medium repeats this action until the last color displayed does not match the playing media of the player who activated it. Then the playing medium is passed to the player on the right, who now gets to activate the transparent playing medium and follow the same procedure as the previous player. This continues until only player is left in the game, who is then declared the winner.

Other variations of the game using the transparent playing medium may also be played. For instance, the group may decide to change the rule so that whoever holds playing media that match the last color shown on the transparent playing medium gets to eliminate another player, or that the medium is passed to the player on the left, etc.

Although this invention has been described with a certain degree of particularity, it is to be understood that the present disclosure has been made only by way of illustration and that numerous changes in the details of construction and arrangement of parts may be resorted to without departing from the spirit and the scope of the invention.

I claim:

1. An article of manufacture, comprising:

a set of playing media comprising two or more playing medium having first and second sides wherein the first side has an identifying indicia and the second side has a question thereon and the answer to said question is also affixed to the second side; and one playing medium of the set having a first side and a second side, light emitting diodes of differing colors between the sides, a button that activates said light emitting diodes, and a random sequence generator that determines an order of the different colored light emitting diodes that are activated.

2. The article of claim 1, wherein the playing media is a wooden stick.

3. The article of claim 1 wherein the playing media is a card.

4. The article of claim 1 wherein the playing media is plastic.

5. The article of claim 1, wherein the identifying indicia is color.

6. The article of claim 1, wherein the identifying indicia is a design.

7. The article of claim 1, further comprising a plurality of playing media.

8. The article claimed 7, wherein the playing media are sticks and the identifying indicia are colors.

9. The article of claim 8, wherein the playing media have questions selected from different topic categories.

* * * * *